US006545416B1

(12) United States Patent
Fisher et al.

(10) Patent No.: US 6,545,416 B1
(45) Date of Patent: Apr. 8, 2003

(54) PORTABLE HMI FIXTURE WITH INTEGRAL BALLAST

(76) Inventors: Ken S. Fisher, 5528 Vineland Ave., North Hollywood, CA (US) 91601; Kevin C. Baxter, 1847 Verdugo Vista Dr., Glendale, CA (US) 91208

( * ) Notice: Subject to any disclaimer, the term of this patent is extended or adjusted under 35 U.S.C. 154(b) by 0 days.

(21) Appl. No.: 09/818,323

(22) Filed: Mar. 27, 2001

(51) Int. Cl.[7] ..... H01J 13/46

(52) U.S. Cl. ..... 315/56; 315/71; 362/218; 362/310

(58) Field of Search ..... 315/56, 71, 72; 362/264, 218, 310, 327

(56) References Cited

U.S. PATENT DOCUMENTS 4,536,832 A * 8/1985 Lemons ..... 362/264

6,271,629 B1 * 8/2001 Pace et al. ..... 315/56

* cited by examiner

*Primary Examiner*—David Vu

(74) *Attorney, Agent, or Firm*—Fellers, Snider, Blankenship, Bailey & Tippens, P.C.

(57) ABSTRACT

A portable HMI light fixture with integral ballast for use in the motion picture and television industries. The inventive HMI fixture includes: a housing having a front portion and a rear portion; a socket secured in the front portion for removably receiving an HMI bulb; a ballast secured in the rear portion; and a thermal barrier separating the front and rear portions. Preferably the thermal barrier includes a reflective forward surface to direct radiated energy away from the rear portion, provides thermal insulation between the front portion and rear portion, and restricts airflow between the front and rear portions.

7 Claims, 2 Drawing Sheets

PORTABLE HMI FIXTURE WITH INTEGRAL BALLAST

BACKGROUND OF THE INVENTION

1. Field of the Invention

The present invention relates to a portable HMI lighting fixture. More particularly, but not by way of limitation, the present invention relates to portable HMI lighting fixtures for use in the motion picture and television industries having an integral, high frequency ballast.

2. Background of the Invention

HMI lighting equipment enjoys widespread acceptance in the motion picture and television industries. Perhaps the two primary factors for the acceptance of HMI lighting are:

a) the color temperature of the light produced by an HMI bulb is very close to daylight; and b) HMI lights are very efficient compared to tungsten lights. Unfortunately, like other types of arc lamps, HMI bulbs require a ballast to limit the electrical current flowing through the bulbs and an ignitor is required to initiate the arc.

Portable lighting plays an important role in the motion picture and television industries. Unlike theater lighting, where a lighting installation is typically long term and in place for a number of performances, motion picture lighting is usually setup for a relatively short period of time and, even during the short time, a particular lighting arrangement is in place, the individual lights often undergo numerous adjustments in position, height, angle, intensity, and the like.

While HMI lights are presently used for temporary lighting, they suffer from a number of limitations which adversely impact their functionality. For example, as previously mentioned, HMI lights require a ballast. Due to the size and weight of a typical ballast, the ballast is traditionally housed in a separate enclosure. A cable then connects the fixture to the ballast and a second cable is used to connect the ballast to incoming AC power. In addition, ignition of the bulb is handled in a number of different ways. Ignitors are typically placed in or near the fixture but occasionally may be found in the ballast or along the wiring between the fixture and the ballast. Depending on the ballast, an ignitor pulse may be generated either automatically or by manual actuation of a switch. Furthermore, ignition of a hot bulb requires an ignition sequence different from that of a cold bulb which, with many ballasts, results in an unacceptable amount of time to re-strike the arc.

These limitations might best be understood by comparing HMI lighting to tungsten lighting. A typical tungsten light is housed in cylindrical housing. A reflector behind the bulb, or integral with the bulb, ensures that the bulk of the light produced will exit the front of the housing. A Fresnel lens is often secured over the front of the housing to provide a degree of focusing, thereby allowing the light to be aimed at a particular spot. The tungsten bulb connects directly to AC power and a simple on/off switch may be provided to activate or deactivate the bulb. Dimming may be accomplished by simply plugging the light into a conventional, off-the-shelf light dimmer. In contrast to HMI lamps, tungsten bulbs employ a filament which may be extinguished and re-activated at will simply by reapplying power to the bulb. Thus, tungsten lights are easy to set-up and simple use. Unfortunately, the color temperature of a tungsten light is not close to daylight; the color temperature varies widely with dimming or variations in the line voltage; and the bulbs are not particularly efficient.

A typical HMI light is likewise housed in a cylindrical housing. A reflector is usually provided behind the bulb, or integral with the bulb, to ensure that the bulk of the light is directed towards the front of the housing. A Fresnel lens may be secured over the front of the housing to provide a degree of focusing, likewise allowing the light to be aimed at a particular spot. However, in contrast, the HMI bulb cannot be directly connected to AC power. Instead, the ballast must be provided between the bulb and AC power and an ignitor is required to "strike" the bulb to initially start the arc. Due to its size, weight, and sensitivity to heat, the ballast in present HMI lighting equipment for the motion picture and television industries is physically separated from the fixture, thus limiting the portability of HMI lighting equipment.

HMI ballasts are available in a variety of configurations. As with ballasts for other types of arc lamps, HMI ballasts can be grouped broadly into two categories, namely: a) magnetic ballasts; and b) electronic ballasts. Magnetic ballasts limit the current passing through the bulb by providing an inductor between the HMI bulb and the power line, relying on the impedance of the inductor at the line frequency (e.g., 60 Hz in the U.S. or 50 Hz in Europe) to limit current through the bulb. The size and weight of a magnetic ballast is dictated by the inductor which is typically rather large and heavy. Thus, magnetic ballasts are particularly inappropriate for use with portable lights.

Electronic ballasts, generally speaking, rectify the voltage from the AC line into a DC voltage. The DC voltage is then "chopped" at a relatively high frequency, typically in the range of 20,000 Hz to 200,000 Hz. An inductor is then placed between the high frequency output and the bulb to limit the current passing through the bulb. At this higher frequency, the inductor will be of a radically smaller value and, therefore, of much smaller physical size than the inductor incorporated in a magnetic ballast. Typically, this reduction in the size and weight of the inductor more than offsets the size and weight of the additional electronic components required for rectification and chopping, resulting in a substantially smaller and lighter ballast than its magnetic counterpart.

It should be noted that, in setting up lighting equipment for use in filming, the light fixtures are often mounted on stands or suspended from trusses. In either case, the light fixtures are typically manually lifted into place. Thus, adding the weight of a magnetic ballast and increasing the size of the light fixture to accommodate such a ballast would severely degrade the functionality of the fixture. It should also be noted that while an electronic ballast may not increase the size and weight of the fixture to unacceptable levels, such ballasts are typically sensitive to the extreme heat produced within the light fixture by the bulb.

Thus, it can be seen that there is a need for a HMI lighting equipment which provides the benefits of HMI lighting but may be setup and operated with the ease of a tungsten light.

SUMMARY OF THE INVENTION

The present invention provides an HMI light fixture with integral ballast which satisfies the needs and alleviates the problems mentioned above. The inventive apparatus comprises: a housing having a front portion and a rear portion; a lamp socket housed in the front portion; an HMI lamp removably engaged in the socket; an electronic ballast secured in the rear portion; and a thermal barrier separating the front portion and the rear portion.

In one embodiment, an ignitor is provided in the housing such that the bulb is automatically ignited as power is applied to the ballast. An on/off switch is provided on the housing, or in a cord for connecting power to the fixture, allowing activation or deactivation of the HMI light by simply changing the state of the switch. Furthermore, it is preferable that the ballast employed in the inventive fixture includes hot re-strike capability to further simplify operation of the HMI light.

The size and weight of an electronic ballast are inversely related to the frequency of operation of the ballast. For HMI ballasts providing adequate power output, presently the state-of-the-art limits the upper end of the frequency range to about 200 kilohertz. At this frequency, the size and weight of a ballast required to drive an HMI bulb becomes relatively small compared to the other components such as the housing, socket, and the bulb itself. Thus, an HMI light fixture may be constructed which includes an integral ballast but which provides the ease of handling of tungsten fixtures.

Locating a ballast in the proximity of the bulb has also been limited by the heat produced by both the bulb and the ballast. The use of fans is impractical in fixtures of the inventive type since audio is often recorded along with the filming of images. Thus, the ballast must be thermally isolated from the bulb to maintain the electronic components at an operable temperature. In the inventive device, a thermal barrier separates front and rear portions of the housing to thermally isolate the ballast from the HMI bulb. The thermal barrier preferably includes a reflector to direct radiant heat away from the rear portion and an insulative barrier further separates the front and rear portions to reduce the heat transmitted to the rear portion of the housing through conduction. Finally, the thermal barrier restricts air flow between the front and rear portions to reduce heating of the rear portion through convection.

Further objects, features, and advantages of the present invention will be apparent to those skilled in the art upon examining the accompanying drawings and upon reading the following description of the preferred embodiments.

DESCRIPTION OF THE PREFERRED EMBODIMENTS

Figure 1:
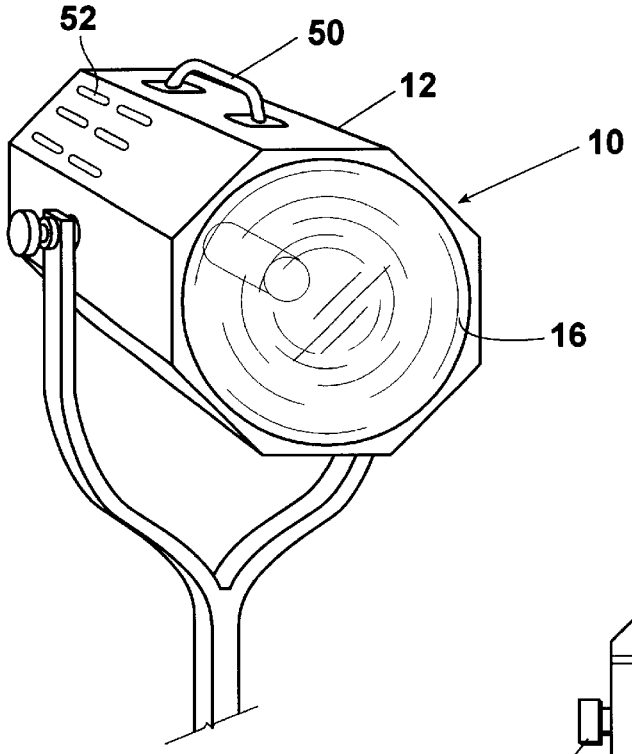
FIG. 1 provides a perspective view of a preferred embodiment of the portable HMI lighting fixture with integral ballast.

The present invention provides a new apparatus for providing illumination for filming motion pictures or television programming. Referring first to FIG. 1, a preferred embodiment of the HMI light fixture with integral ballast 10 comprises: a housing 12; threaded mounts 14 provided on housing 12 for attaching a bracket for supporting the housing 12 from a stand or suspending from an overhead support; a Fresnel lens 16 supported on the front of housing 12; and preferably, handle 50 is provided for lifting fixture 10 into place.

Figure 2:
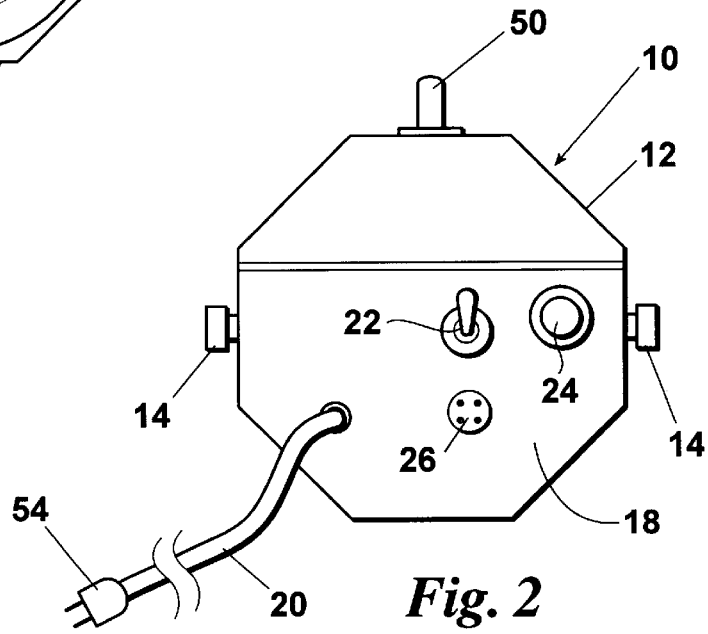
FIG. 2 provides a rear view of a preferred embodiment of the portable HMI lighting fixture with integral ballast.

Referring next to FIG. 2, fixture 10 further includes: on/off switch 22; dimming knob 24; and connector 26 for external control of the light, all provided on back cover 18. Soffit 28, likewise located on back cover 18, provides some protection from rain for switch 22; knob 24; and connector 26 when used outdoors. Cord 20 exits back cover 18 for connection of fixture 10 to an electrical power source.

Figure 3:
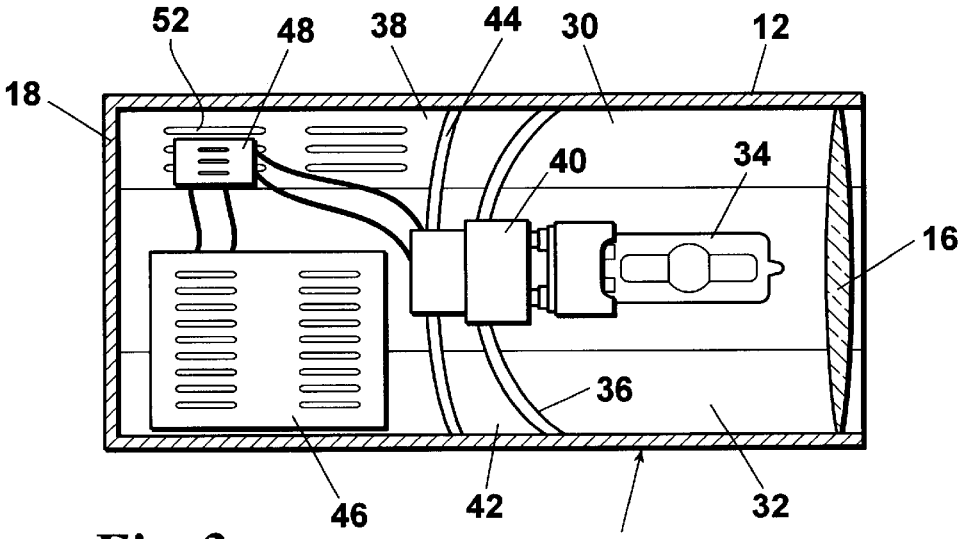
FIG. 3 provides a cutaway top view of a preferred embodiment of the portable HMI lighting fixture.

As best seen in FIGS. 2 and 3, preferably housing 12 is an elongated shell creating a cavity 30 having an octagonal cross section and separated into a forward portion 32 and a rearward portion 38 by reflector 36 and bulkhead 44. Lamp 34 is removably engaged in socket 40 which is secured in forward cavity 32. Reflector 36 is positioned at the rearward end of forward cavity 32 to both reflect rearward shining light back towards lens 16 and to reflect radiant heat from the bulb towards the front of fixture 10 and out of the housing. In addition, reflector 36 restricts airflow between forward cavity 32 and rearward cavity 38 to reduce heat transfer to the rearward cavity 38 through convection.

Bulkhead 44 further separates forward cavity 32 from rearward cavity 38, providing thermal insulation between the cavities 32 and 38, thereby reducing the heat transfer between the cavities 32 and 38 through conduction. As will be apparent to those skilled in the art, bulkhead 44 provides two opportunities to thermally insulate front portion 32 from rear portion 38. First, bulkhead 44 restricts the airflow between forward cavity 32 and rearward cavity 38 creating dead air space 42 which provides insulation. Furthermore, bulkhead 44 may itself be made from a material, such as fiberglass, which is a relatively poor thermal conductor. While preferably a device constructed according to the present invention will take advantage of both opportunities to insulate between cavities 32 and 38, either an airspace 42 or constructing bulkhead 44 from an insulative material will suffice to limit heating of rear portion 38 through conduction to an acceptable level.

Thus, reflector 36, bulkhead 44, and airspace 42 provide a thermal barrier between front cavity 32 and rear cavity 38 by limiting heat transfer between cavities 32 and 38 through radiation, conduction, and convection. As will be apparent to those skilled in the art, the thermal barrier could be incorporated into a single unit. By way of example and not limitation, one such unit could be constructed by lining the back side of the reflector with a nonflammable, insulating material. Thus, if the reflector substantially limited airflow between the front portion and rear portion, it could provide thermal blocking as a single unit.

Ballast 46 and ignitor 48 are mounted in the rearward cavity 38. The thermal barrier formed by reflector 36, bulkhead 44, and airspace 42, prevent a significant portion of the heat produced by bulb 34 from reaching ballast 40. In addition, vents 52 are provided in housing 12 to allow air circulation through rearward cavity 38 which provides cooling of ballast 46.

HMI bulbs are available in a variety of styles, however such styles may be broadly grouped into two categories: a) conventional globed bulbs having a transparent globe surrounding the bulb except at the base; and b) bulbs which have an integral reflector rearward of a forward facing lens, such as, for example, PAR type bulbs. The foregoing preferred embodiment is directed towards a fixture for a conventional globed bulb. However, the latter type of bulb is also well suited for use with the inventive fixture and the use with such a bulb is within the scope of the present invention.

Figure 4:
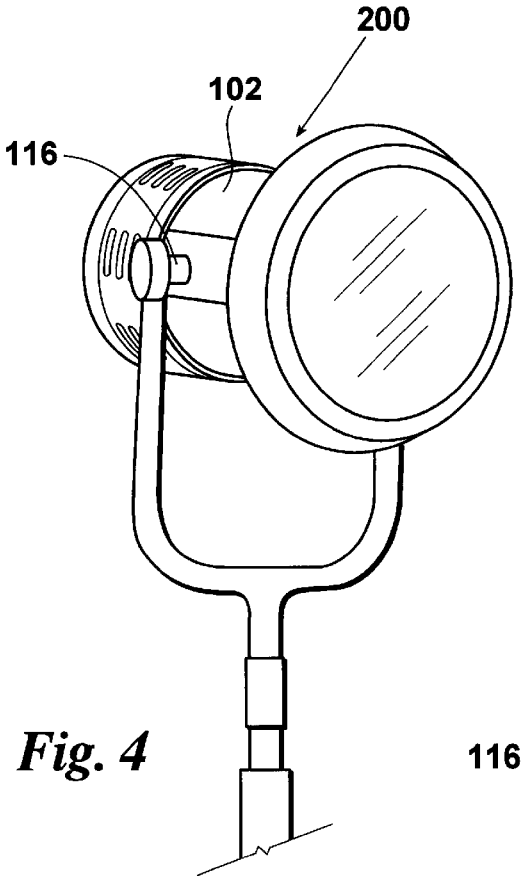
FIG. 4 provides a perspective view of a second preferred embodiment of the portable HMI lighting fixture with integral ballast.
Figure 5:
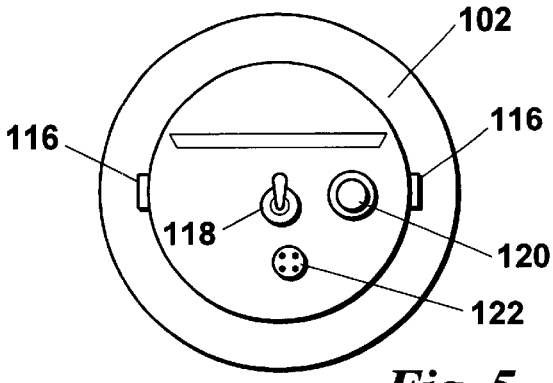
FIG. 5 provides a rear view of the second preferred embodiment of the portable HMI lighting fixture with integral ballast.
Figure 6:
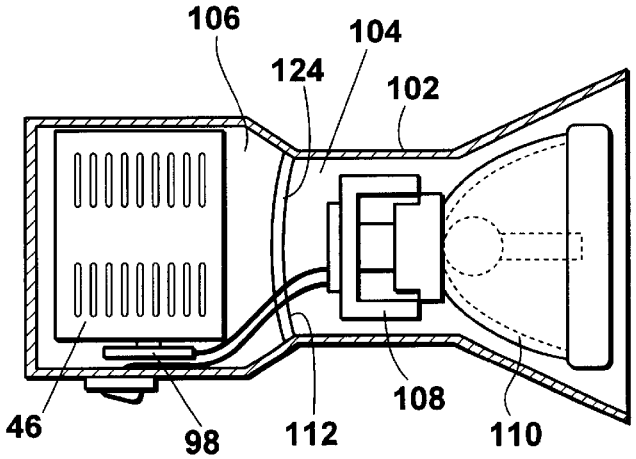
FIG. 6 provides a cutaway top of the second preferred embodiment of the portable HMI lighting fixture.

Referring next to FIGS. 4, 5, and 6, in an alternate embodiment, the inventive portable HMI fixture 100 is intended for use with an HMI bulb having an integral reflector. Since the reflector will direct both light and heat towards the front of the housing, a separate reflector between the front and rear portions is not necessary. Fixture 100 comprises: a housing 102 having a forward portion 104 and a rearward portion 106; a socket 108 secured in forward portion 104 for removably receiving a PAR type HMI bulb 110; an insulative bulkhead 112 separating front and rear portions 104 and 106, respectively; electronic ballast 46; and ignitor 48. Mounts 116 are provided on housing 102 for supporting fixture 100 and switch 118, dimming knob 120, and dimming connector 122 are provided on the rear of housing 102.

It should be noted that bulkhead 112 both provides thermal insulation between forward cavity 104 and rearward cavity 106 to reduce heat transfer through conduction, and restricts airflow between cavities 104 and 106 to reduce heat transfer from convection. Preferably the front surface 124 of bulkhead 112 is reflective so that any light reaching bulkhead 112 will be reflected towards the front of housing 102 rather than absorbed by bulkhead 112.

As will be apparent to those skilled in the art, while the preferred embodiments are shown and described as having a separate ignitor 48, the ignitor could be incorporated into ballast 46 or, alternatively, ignitor 48 could be located in forward cavity 32 or 104. All of such configurations are within the scope of the present invention.

Preferably ballast 46 is an electronic ballast operating at a frequency of at least 20 kilohertz, most preferably operating at approximately 200 kilohertz. Such ballasts are known in the art and are available with a variety of features including, by way of example and not limitation: automatic ignition; hot re-strike capability; and power factor correction. It should be noted that, while such features are desirable, they are not necessary to practice the present invention.

Referring again to FIG. 2, in operation, the power cord 20 is attached to a source of electrical power typically to AC power through a conventional power connector 54. To turn on the HMI light, switch 22 is placed in the "on" position thereby applying power to ballast 46. Upon receiving power, ballast 46 first develops a starting voltage and then issues an ignitor pulse to ignitor 48 thereby striking the bulb 34. After striking, the brightness of the bulb may be adjusted within a limited range by turning knob 24. If the bulb is momentarily extinguished (i.e., through a momentary loss of power, or turning the switch off and back on), ballast 46 develops a hot strike voltage and then issues an ignitor pulse to re-ignite the bulb 34.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention.

What is claimed is:

1. A portable HMI light fixture having an integral ballast comprising;

a housing having an interior;

a thermal barrier separating said interior into a front portion and a rear portion;

a socket secured in said front portion for removably receiving an HMI bulb; and an electronic ballast secured in said rear portion.

2. The HMI light fixture of claim 1 wherein said thermal barrier comprises a reflector for reflecting light and heat radiating from an HMI bulb away from said ballast.

3. The HMI light fixture of claim 1 wherein said thermal barrier comprises an insulative bulkhead.

4. The HMI light fixture of claim 1 wherein said electronic ballast includes an ignitor.

5. The HMI light fixture of claim 1 wherein said electronic ballast has an operating frequency of 200 kilohertz.

6. The HMI light fixture of claim 1 wherein said ballast include hot re-strike capability.

7. The HMI light fixture of claim 1 further comprising a switch having a first position and a second position wherein when said switch is in said first position, electrical power is not applied to said ballast and when said switch is moved from said first position to said second position, electrical power is applied to said ballast and said ballast automatically causes a high voltage ignition pulse to be applied to an HMI bulb.

* * * * *